United States Patent [19]

Vazin

[11] Patent Number: 4,457,349

[45] Date of Patent: Jul. 3, 1984

[54] VOLATILE HYDROCARBON RECOVERY SYSTEM FOR TANK TRUCK UNLOADING HEADERS

[75] Inventor: Gholam R. Vazin, Westminster, Calif.

[73] Assignee: Chevron Research Company, San Francisco, Calif.

[21] Appl. No.: 340,805

[22] Filed: Jan. 19, 1982

[51] Int. Cl.[3] ..... B65B 3/06

[52] U.S. Cl. ..... 141/86; 141/326; 137/312; 138/89

[58] Field of Search ..... 141/37–67, 141/106, 285–310, 311 R–339 Z, 85–88, 115, 98; 137/312, 313, 314, 364, 371; 285/42, 43, 44, 192, 205; 138/89; 4/286, 293, 295; 52/19, 20, 21

[56] References Cited

U.S. PATENT DOCUMENTS

| | | | |
|---|---|---|---|
| 3,732,902 | 5/1973 | Muller | 141/326 |
| 3,785,413 | 1/1974 | Traverner et al. | 141/326 |
| 4,090,525 | 5/1978 | Potter | 141/52 |
| 4,204,564 | 5/1980 | Balfour | 141/311 A |
| 4,310,033 | 1/1982 | Deters | 141/59 |

OTHER PUBLICATIONS

"Bulk Plant Guidelines for Oil Spill Prevention and Control" (Pace Report No. 80-3; Petroleum Assn. for Conservation of the Canadian Environment; 9/80).

*Primary Examiner*—Houston S. Bell, Jr.

*Attorney, Agent, or Firm*—Burns, Doane, Swecker & Mathis

[57] ABSTRACT

This patent specification discloses a system for reducing pollution of soil, water and air due to spillage of liquid hydrocarbons. Such liquids are transferred by gravity flow from a tank truck compartment to a bulk storage tank through a flexible loading hole. The hose is connected to the bulk storage tank pumping system by a ground level connector which is enclosed within an open top box. The bottom plate of a box is tilted to horizontal and forms a cover for an unloading chamber or pot serving as a pump reservoir between the hose connector and the storage tank pump system. The sidewalls of the box extend above and around the hose connector to catch spills or leaks from the gravity fed loading hose when it is connected to, or disconnected from, the pumping system. A sump pot is arranged at the low end of the tilted bottom plate for recovery of any spilled liquid. The box may accommodate from one to several unloading headers with a single sump pot. Liquid in the sump pot is drained to a slop tank for recovery or disposal. A vapor recovery system is connected to the sump pot drain line and through a gas vent valve to the vapor space at the top of each unloading chamber to prevent air pollution also.

11 Claims, 4 Drawing Figures

VOLATILE HYDROCARBON RECOVERY SYSTEM FOR TANK TRUCK UNLOADING HEADERS

The present invention relates to apparatus for preventing contamination of the environment due to leaks or spills of volatile hydrocarbon liquids during loading or unloading of such liquids through a flexible tank truck delivery hose when the hose is connected to or disconnected from a bulk plant storage and distribution system. More particularly, it relates to apparatus for avoiding earth, water, or air contamination due to leakage when a flexible hose is connected or disconnected between a delivery tank truck and an unloading header to supply a piping and pump system by gravity feed to transfer liquids to or from a bulk storage tank.

It is a particular object of the present invention to avoid contamination of earth, water, or air when a flexible delivery hose is connected between a delivery vehicle and a bulk storage tank for supplying or delivering volatile hydrocarbon liquids through a pumping and pipe delivery system. The hose connector, in accordance with the invention, is incorporated in an unloading header comprising an open top enclosure box having a bottom plate overlying and sealed to a product unloading pot or chamber. Similarly, a sump pot is disposed parallel and adjacent to the product unloading pot with an upper opening through the bottom plate of the enclosure box. The opening into the sump pot is below the unloading hose connector. A hydrocarbon vapor recovery or vent line communicates through a vent valve with the upper portion of the unloading chamber and additionally communicates with a vent connected to a drain line from the sump pot to a slop tank. Thus, hydrocarbon vapors generated either in the unloading chamber or in the sump pot and its drain line may be prevented from entering the atmosphere through the vapor recovery system. Preferably, but not necessarily, the unloading header arrangement may include a plurality of parallel unloading chambers or pots secured below the enclosure box bottom plate and each pot is sealed to its own hose connector by the plate with its outlet connected to a separate storage tank through a pump and pipe delivery system. Further, in accordance with a preferred form of the invention, the vapor unloading line to each of the enclosed unloading chambers includes a fluid float valve to prevent withdrawal of liquid from the chamber into the vapor recovery system. Desirably, but not necessarily, the unloading chamber outlet to the storage system piping is smaller in cross-sectional area than the unloading hose connection inlet or the unloading chamber.

BACKGROUND OF THE INVENTION

In marketing of hydrocarbon fluids, such as kerosene, cleaning fluid, gasoline additives, and other bulk products, distribution from a refinery to a sales point is normally through a bulk plant or distribution terminal. Such a terminal serves as a supply center for consumer sales outlets, for example, service stations, cleaning plants, manufacturing facilities and the like. This type of bulk liquid distribution center frequently differs from fuel terminals for automotive and aviation sales where volume of sales may justify the cost of laying a pipe line from a refinery to the bulk storage or distribution plant. Fuel products from local bulk storage at an airport, gasoline or diesel distributor, may however, in turn, be distributed in discrete quantities or "batches" to planes, or automotive fuel stations by a local unloading header arrangement. Customarily, in sale and distribution of bulk products, other than motor fuels, such products are delivered in batches of a few hundred gallons to a bulk station or to a sub-distributor through a tank truck. In batch handling of kerosene, cleaning fluid and the like, delivery from compartments on a tank truck are by a gravity hose connectable to a storage tank through a pipe delivery system. The delivery system normally includes a hose coupler for interconnecting a truck delivery hose to an unloading chamber, a pipe delivery line and pump for pumping liquid to the storage tank. The hose coupler is generally located at grade, or below, for gravity flow of hydrocarbons from a tank truck compartment through an unloading valve located a few feet above ground level. Liquid flows by gravity into the unloading pot or chamber. The purpose of the unloading chamber is to assure that there is an adequate head of liquid above the bulk storage pump inlet, to prevent pump "cavitation" which might introduce air into the liquid.

Pollution of earth, air, or water in the United States and other developed parts of the world is now controlled by local and national laws, or regulations, which require that all potential sources of such pollution be carefully controlled. In general, handling of all hydrocarbon liquids or fluids requires that spills be avoided wherever possible and that any spills be collected. Heretofore this has required manual or machine cleanup of any such spills. In transferring bulk liquid hydrocarbon in batches from a central distribution terminal is by a tank truck or a tank car. As noted above, liquid delivery from the tank truck compartment usually depends upon gravity flow through a flexible loading hose from the tank truck or car to a pipe system connected to a storage tank. Additionally, distribution from a major storage terminal to another point of smaller usage may also require delivery by a tank truck from the intermediate storage tank to an ultimate user, such as a paint manufacturer, cleaning establishment, or a local gasoline distributor. In such systems, liquid delivery from the tank truck to such a local storage system is also by gravity flow through a flexible loading hose. Further, in distribution of product in a storage tank to a tank truck compartment for such delivery, flow may be reversed and pumped through the loading hose up into the truck tank. In systems of this type, a control valve for flow into, or out of, the truck compartment is at the bottom of the tank truck. When the truck valve is closed the hose will normally retain a small amount of liquid after the supply is shut off. The hose must then be drained through the loading interconnect, or hose connection, between the hose and the storage tank piping system. It is customary to avoid spillage directly at the tank truck, because of the hazard and difficulty of collecting any spillage under the tank truck outlet, by disconnecting the hose at the downstream connector. Such connector is generally at ground level or below. Accordingly, leakage often occurs inadvertently, and without possibility of prevention, when the delivery hose is disconnected from such an unloading header connector. Even when great care is exerted to drain the hose during the disconnect step, leakage may occur around the connector onto the ground or in the vicinity of the unloading connector.

It has been known to use an unloading chamber below the hose connector. This unloading chamber usually is larger in diameter than the hose to permit enough liquid to be accumulated in the system to fill the pipe line up to a pump, normally positioned near the inlet line. The off-loaded liquid is then pumped from the chamber to a storage tank through normal piping. One particular purpose of having a larger volume storage tank is to assure that the pump has an adequate volume of liquid above the line prior to starting the pump. Thus, the pump will not entrap and incorporate air into the hydrocarbon liquid as it is being pumped into the tank. However, no system for recovering spillage or leakage upon connecting or disconnecting a tank truck unloading hose has been known prior to the present invention.

In accordance withthe present invention, an open top closure box overlies and forms a cover for the loading pot. The sides of the box extend above the hose connector so that the connector lies entirely within the open top box. Desirably, the top of the open box lies below grade so that both the unloading chamber and the box are below the level of the delivery compartment of the tank truck and the hose connector on the truck. Further, the box and chamber are below grade to prevent spills around them. In this way fluid flows from the tank truck under gravity and any liquid spilled from the connector flows into and is captured within the open box top. Further, in accordance with the arrangement of the present invention, at least the base of the box is tilted toward one end, and a sump pot is arranged in parallel to the unloading chamber and at the low end of the box. A drain line from the sump pot is connected to a slop tank. The drain line also includes a vapor recovery line, which may be connected to a vapor recovery system in parallel with a vapor recovery connection through a gas-only valve at the top of the unloading pot. In a preferred form, a removable grating overlies at least a portion of the open-box and covers the hose connector, as well as both the sump pot and the unloading chamber assembly. In an alternative form, a plurality of unloading chambers, each connected to separate storage lines and storage tanks, are integral with the bottom of the open-box and in parallel with a single sump pot.

Further, objects and advantages of the present invention will become apparent from the following detailed description taken in conjunction with the accompanying drawings, which form an integral part of this specification.

DESCRIPTION OF THE PREFERRED EMBODIMENTS

Figure 1:
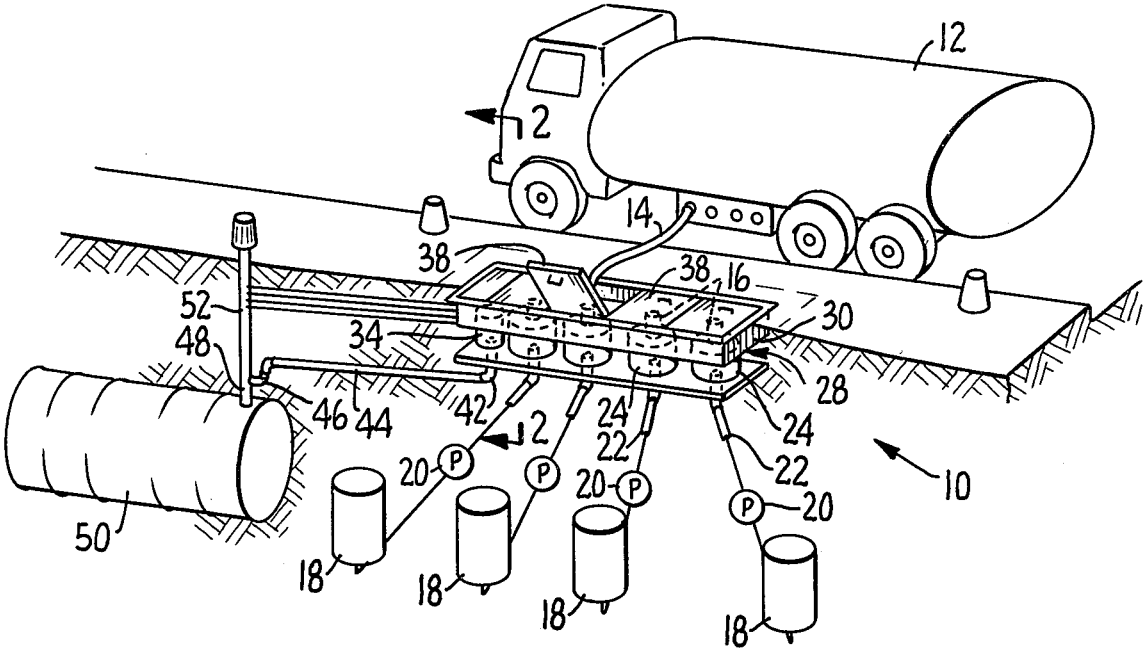
FIG. 1 is a perspective view of an unloading header system, suitable for gravity supply of hydrocarbon fluids to any of a plurality of storage tanks through any one of a plurality of unloading chambers forming a part of the header system and providing in accordance with the present invention a liquid and vapor recovery system interconnected to recover any spillage from the unloading header through a sump pot disposed in parallel with the unloading chambers.

Referring now to the drawings, in FIG. 1 an unloading header system 10 provides means for gravity unloading of a hydrocarbon or petroleum liquid product from a compartment in tank truck 12 through an unloading hose 14. A hose connector 16 forms a part of header system 10 through which hydrocarbon product is delivered to a storage tank, such as any of the tanks 18, by pump 20 through pipe delivery line 22. (It will be understood that for the sake of illustrative clarity, tanks 18 are shown to be considerably smaller than the remainder of the system, but in fact are several times larger, with a capacity on the order of 10–50,000 gallons.) While each storage tank 18 has its own piping system 22, it will be apparent that a single pump 20 could be used with suitable valving to serve several tanks from a single hose connector 16 and a single unloading chamber 24 in header 10.

Figure 2:
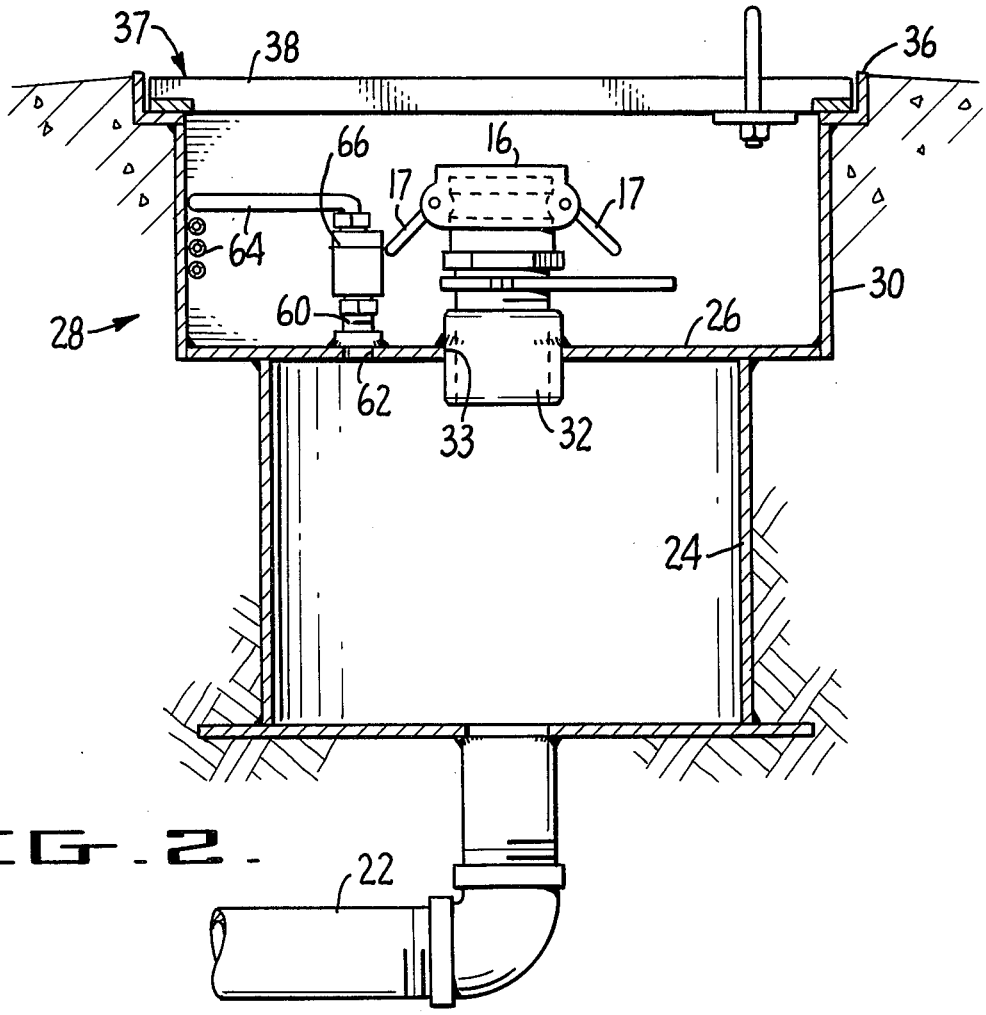
FIG. 2 is an enlarged cross-sectional view in the direction of arrows 2—2 in FIG. 1 through the unloading header and one of the unloading pots or chambers.
Figure 3:
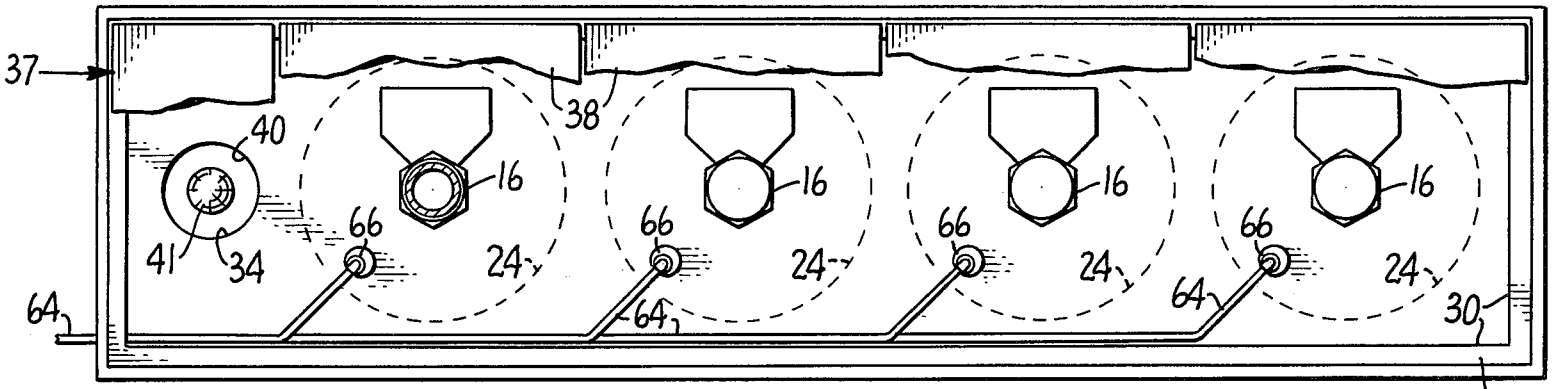
FIG. 3 is a plan view of a portion of the system of FIG. 1, particularly illustrating the unloading header.

As best seen in FIG. 2, header system 10 comprises an unloading pot or chamber 24 forming a liquid pumping reservoir for the petroleum product. Such a pot assures sufficient hydraulic head so that liquid alone is supplied to pump 20 by delivery pipe 22, as indicated in FIG. 1.

Pot 24 is filled by gravity drainage from tank truck 12 through hose 14 which is arranged (in a manner well known in the art) to be sealed to hose coupling or connector 16 by operation of bails 17. In accordance with the present invention connector 16 is secured to coupling 32 which in turn is welded in opening 33 through bottom plate member 26 forming the base or bottom of spill-capture means, formed as an open top enclosure, box 28. As shown, sidewalls 30 of box 28 extend sufficiently above the top of connector 16 so that upon uncoupling of hose 14 from connector 16, any possible leakage or spillage from hose 14 will be captured within sidewalls 30.

It will be noted in FIG. 1, that four unloading chambers 24 are mounted on and below base, or bottom closure, plate 26. Because spillage is likely and frequently unavoidable, contamination of earth and any water runoff around the unloading header, as during rains or washdown, is avoided by capture within open top box 30. As suggested by the drawings and in particular FIG. 2, the upper rim 36 of sides 30 of box 28 are located slightly above grade and support removable protective grating arrangement 37, formed in a plurality of segments 38. Each segment 38 may be pivoted, as indicated in FIG. 1, to expose one of the hose connectors 16 for connection to a gravity feed hose 14.

Figure 4:
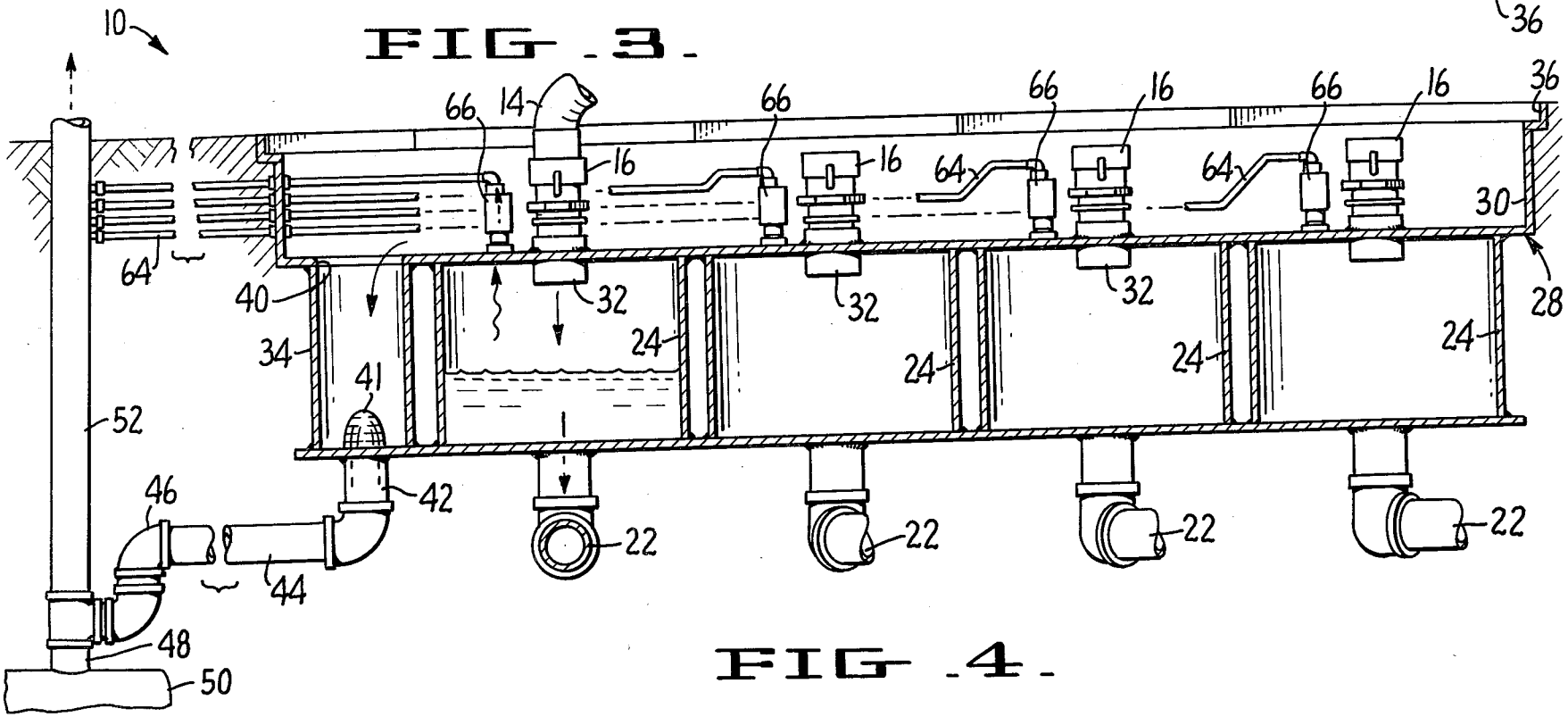
FIG. 4 is a vertical cross-sectional view through the center line of the unloading header system of FIG. 3 with addition of a sump pot drain and vapor recovery systems.

In parallel with unloading chamber 24 is a sump pot 34 also secured to bottom closure plate 30. As best seen in FIG. 4 the location of sump pot 34 is at one end of open top box 28, and as further indicated in FIG. 4, at least bottom plate 26 of box 28, is tilted toward pot 34 to assist in draining any spilled liquid from around any of the couplers 16. As shown, pot 34 is parallel with chambers 26 and includes an inlet 40 for readily draining the upper surface of plate 26 of any leaked liquid. The outlet from sump pot 34 through line 42 is desirably covered by a screen 41 to prevent entry of paper, rocks, bolts or other debris into drain line 42.

Drain pipe 42 is connected to drain, or outflow, line 44. Drain line 44 preferably includes a trap connection through elbow 46 to inlet line 48 into slop tank 50. Riser pipe 52 provides a vapor removal line from both line 44 an tank 50. Vapor recovery line 52 is preferably (and generally legally required to be) connected to an external vapor recovery system (not shown).

Each of the unloading chambers is also provided with a vapor recovery or vent system connection including a nipple or coupling 60, as shown in FIGS. 2 and 4. Nipple 60 is threaded into an outlet 62 in bottom plate 26 opening into the top of chamber 24. Vapor or vent recovery line 64 is connected to outlet 62 through vapor vent valve 66 which includes a liquid float member to prevent any liquid overfilling chamber 24 from being drawn out through vent line 64. This float means closes the valve if liquid rises therein. It is important in this service that there be no liquid by-pass of valve 66 into line 64. Lines 64, as indicated in FIGS. 1 and 4 are also connected to the vapor recovery system through riser 52.

In operation, hydrocarbon fluid product is delivered to a bulk storage tank 18 from a compartment of tank truck 12 to unloading header system 10 through flexible loading hose 14. For this delivery, one section 38 of grating 37 is exposed as in FIG. 1 and the hose is connected first to one of the truck valves and then to coupling 16. The product fills unloading chamber 24 and then pump 20 pumps product into fill tank 18 through pipe line 22. Any leakage from hose 14 upon connection, or any spill after delivery is completed, will leak around connector 16 and be captured within sidewalls 30 of spill-capture box 28. Such spilled liquid will drain on tilted bottom plate 26 to sump pot 34. The collected spill then gravity drains through inlet 40 into pot 34 and enters drain line 44 for delivery to slop tank 50. From tank 50, such hydrocarbon material may be recovered, burned as fuel, or disposed of.

Generally, product is delivered from storage tank 18 to a similar tank truck for distribution to a subdistributor or to the end user through a metering system. However, for pollution control, the system of the present invention may also be used to load a tank truck 12 for redistribution of product from a storage tank 18. In such an operation, hose 14 is first connected to the loading valve (not detailed) on truck 12 and then to header coupling 16. Product may then be delivered by filling chamber 24 through line 22 and pump 20. Upon completion of loading, the valve on truck 12 is closed and hose 14 drained back into chamber 24 by reversal of pump 20. Any leakage from hose 14 is then caught in spill capture means 28 when hose 14 is first disconnected from header connector 16.

While only a few examples of the preferred embodiments of the invention have been shown and described, various modifications or changes in both apparatus and the method of operating such apparatus will occur to those skilled in the art. All such modifications or changes coming within the scope of the appended claims are intended to be included therein.

I claim:

1. A volatile hydrocarbon fluid unloading header system for avoiding earth, water or air contamination by leakage or spillage from a delivery hose adapted to be connected between said system and a tank truck for said fluid, comprising at least one product unloading pot adapted to be connected to a storage tank through a pumping and pipe delivery system by a pipe outlet in the bottom of said unloading pot, a sump pot disposed parallel and adjacent to said product unloading pot, an open-top enclosure box overlying said unloading pot and said sump pot and having a bottom forming a closure plate for sealingly enclosing the tops of each of said pots, a tank truck hose connector secured to said closure plate and communicating with the top of said unloading pot, a vapor recovery vent formed in said plate means communicating with the interior of said unloading pot and means forming an opening into said sump pot at a level below said hose connector to permit spillage that would otherwise fall on the ground or in water around said unloading header to be withdrawn through said sump pot, an outflow line connecting said sump pot to a slop tank, and a vapor recovery system having a vapor recovery line communicating with said line from said sump pot to said slop tank and with said vapor recovery vent in said unloading pot.

2. Apparatus in accordance with claim 1 wherein a plurality of unloading pots are interconnected to a plurality of product tanks and said cover plate covers each of said product unloading pots and said sump pot whereby said sump pot serves to recover spillage from a hose connected to any of said plurality of unloading pots.

3. Apparatus in accordance with claim 1 wherein said open-top box extends above the top of said hose connector and includes protective grating means overlying said open-top box with at least a portion of said grating being removable for access to the unloading hose header.

4. Apparatus in accordance with claim 1 in which said vent return from said unloading pot includes a fluid float valve to prevent fluid from being trapped in the vent line in the event said unloading pot is overfilled.

5. Apparatus in accordance with claim 1 wherein said outlet from said unloading pot is substantially smaller in diameter than the diameter of said pot and less than the diameter of said hose connector.

6. A hydrocarbon liquid unloading system for a plurality of hydrocarbon products delivered by tank truck through a hose connecting system for gravity feed of said liquid to an unloading chamber from which said product is pumped to a receiving tank for subsequent distribution and wherein spillage from said gravity feed hose and connector system is susceptible of polluting the ground, water or air in the vicinity of said gravity unloading system, which comprises an unloading header module comprising an open top box member having secured thereto an unloading hose connector, an unloading chamber directly beneath the base of said box and secured thereto, a pipe line connector means in the bottom of said chamber for delivery to a tank storage system, said base having formed therein an opening between the unloading hose connector and said chamber, and said base being sloped toward one end of said box, a sump chamber having an inlet through said base and secured thereto at said one end, a line for connecting an outlet from said sump chamber to a slop tank and means for connecting a vapor vent line from a vent space in said sump chamber connecting line and through said base to the vapor space at the top of said unloading chamber to vapor extraction means.

7. Apparatus in accordance with claim 6 wherein a plurality of unloading chambers are interconnected to a plurality of product tanks and said cover plate covers each of said product unloading chambers and said sump chamber whereby said sump chamber serves to recover spillage from a hose connected to any of said plurality of unloading chambers.

8. Apparatus in acccordance with claim 6 wherein said open-top box extends above the top of said hose connector and includes protective grating means overlying said open-top box with at least a portion of said grating being removable for access to the unloading hose header.

9. Apparatus in accordance with claim 6 in which said vent return from said unloading chamber includes a fluid float valve to prevent fluid from being trapped in the vent line in the event said unloading chamber is overfilled.

10. Apparatus in accordance with claim 6 wherein said outlet from said unloading chamber is substantially smaller in diameter than the diameter of said chamber and less than the diameter of said hose connector.

11. A system for unloading volatile hydrocarbon liquids from a tank truck by gravity through a header adapted to be positioned below the tank truck so that upon disconnection of a hose from the underground loading connector spillage from said hose that might contaminate the earth or surrounding atmosphere is captured which comprises an unloading header module comprising an open top box member having secured thereto an unloading hose connector, an unloading chamber directly beneath the base of said box and secured thereto, a pipe line connector means in the bottom of said chamber for delivery to a tank storage system, said base being inclined to the horizontal and having formed therein an opening between the unloading hose connector and said chamber, a line for connecting an outlet at the lower end of said base of said box member to a slop tank and means for connecting a vapor vent line from a vent space in said sump connecting line and through said base to the vapor space at the top of said unloading chamber to vapor extraction means.

* * * * *